United States Patent [19]

McDermott et al.

[11] Patent Number: 5,071,183

[45] Date of Patent: Dec. 10, 1991

[54] TOOL FOR INSTALLING CUTTING BLADES ON GRADERS

[75] Inventors: Jerry L. McDermott, Craig; Jeffrey L. Herfurtner, Steamboat Springs, both of Colo.

[73] Assignee: Peabody Coal Company, St. Louis, Mo.

[21] Appl. No.: 568,477

[22] Filed: Aug. 15, 1990

[51] Int. Cl.[5] ..... B66C 1/22

[52] U.S. Cl. ..... 294/67.2; 294/81.5

[58] Field of Search ..... 294/15, 26, 67.1–67.3, 294/67.5, 81.1, 81.3, 81.4, 81.5, 81.56, 82.1, 86.41, 92; 29/281.1, 283, 700, 822; 269/46

[56] References Cited

U.S. PATENT DOCUMENTS

| | | | |
|---|---|---|---|
| 594,644 | 11/1897 | McCorkile | 294/67.2 |
| 2,579,826 | 12/1951 | Ingram et al. | 294/15 |
| 2,717,801 | 9/1955 | Neil | 294/67.2 |
| 2,981,426 | 4/1961 | Casey | 294/92 X |
| 3,909,056 | 9/1975 | Duwe | 294/67.22 |
| 4,008,817 | 2/1977 | Johnson | 294/67.3 X |
| 4,433,830 | 2/1984 | Campbell | 294/67.2 X |
| 4,818,004 | 4/1989 | Oswalt et al. | 294/67.21 X |

FOREIGN PATENT DOCUMENTS

| | | | |
|---|---|---|---|
| 282194 | 2/1965 | Australia | 294/67.2 |
| 80805 | 7/1951 | Czechoslovakia | 294/67.22 |
| 265288 | 2/1950 | Switzerland | 294/67.2 |
| 592712 | 2/1978 | U.S.S.R. | 294/67.22 |
| 1141064 | 2/1985 | U.S.S.R. | 294/67.2 |
| 1082577 | 9/1967 | United Kingdom | 294/67.21 |

*Primary Examiner*—Johnny D. Cherry

*Attorney, Agent, or Firm*—Senniger, Powers, Leavitt & Roedel

[57] ABSTRACT

A tool for temporarily supporting a cutting blade in its correct angular orientation to facilitate its installation on a grader. The tool comprises an elongate bar, and first and second brackets mounted on the bar at spaced locations. Each bracket includes a slot for receiving and supporting the cutting blade. The tool further comprises a suspension member on the bar, intermediate the brackets. The suspension member is at such an orientation with respect to the brackets that when the tool is suspended by the suspension member, a blade supported in the brackets is at approximately the angle at which it is mounted on the grader.

13 Claims, 1 Drawing Sheet

TOOL FOR INSTALLING CUTTING BLADES ON GRADERS

BACKGROUND OF THE INVENTION

This invention relates to a tool for installing cutting blades on graders, and in particular to a tool for supporting cutting blades in their proper orientation to facilitate their installation on graders.

Grading machines usually include a cutting blade mounted at an angle for cutting the ground to achieve the desired grade. These cutting blades are elongate metal bars which are removably mounted on the grader, for example with bolts, so that the blades can be replaced as they wear out. To replace a blade, the old blade is removed, and a new blade must be held in place at the proper angle while it is secured to the grader. Because the blade is relatively heavy, and because the relatively sharp edges of the blade make it difficult to grasp, the blades can slip from the installer's grip, causing pinched fingers and bruised legs or feet.

SUMMARY OF THE INVENTION

It is among the objects of the present invention to provide a tool to facilitate the installation of replacement blades one graders, and in particular to provide such a tool to support the blades while they are being installed.

The tool of this invention is adapted for temporarily supporting a cutting blade in its correct angular orientation to facilitate its installation on a grader. Generally, the tool comprises an elongate bar and first and second brackets mounted on the bar at spaced locations. The brackets include means for receiving and supporting the cutting blade. A suspension member is mounted on the bar, intermediate the brackets. The suspension member is oriented with respect to the brackets so that when the tool is suspended by the suspension member, a blade supported in the brackets is at approximately the angle at which it is mounted on the grader.

The suspension member is preferably generally L-shaped, comprising a first segment extending from the bar, and a second segment extending generally perpendicularly from the end of the first segment. There is preferably a slot in each bracket for receiving and supporting the blades, the slots being parallel and co-planar to hold the cutting blade in a plane. Each bracket preferably comprises a first segment for supporting the bottom of the blade, and a second segment, shorter that the first segment, and overlying a portion of the first segment to define a slot between the first and second segments for receiving a portion of the blade. The brackets thus have a generally "J" shape. The angle between the plane of the slots and the first segment of the bracket is preferably about 80°.

Because of the orientation between the suspension member and the brackets, when the tool is suspended, for example from a crane, a hoist, or a cherry picker, the tool holds the blade in approximately the same angular orientation that the blade is mounted on the grader. The tool can be used to transport the blade and support the blade as the blade is being secured to the grader. The tool reduces the risk that the cutting blade could slip and cause injury. Thus, the tool facilitates the installation of replacement cutting blades on graders. These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
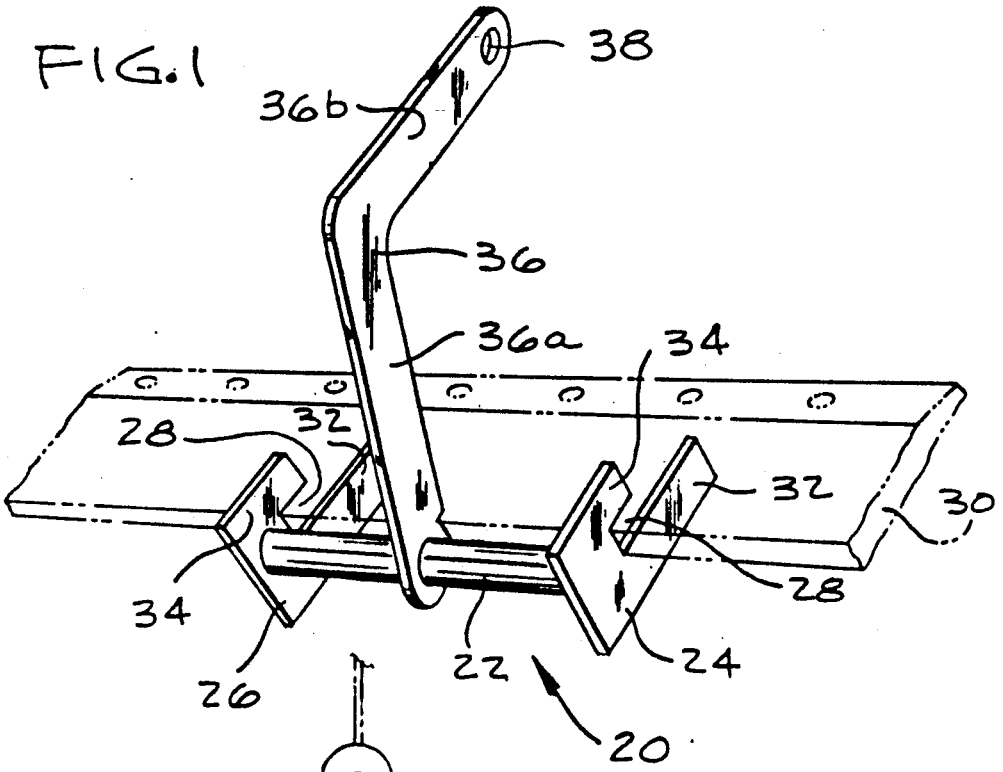
FIG. 1 is a perspective view from behind of a tool constructed according to the principles of this invention, as it would be used to support a cutting blade (shown in phantom)
Figure 2:
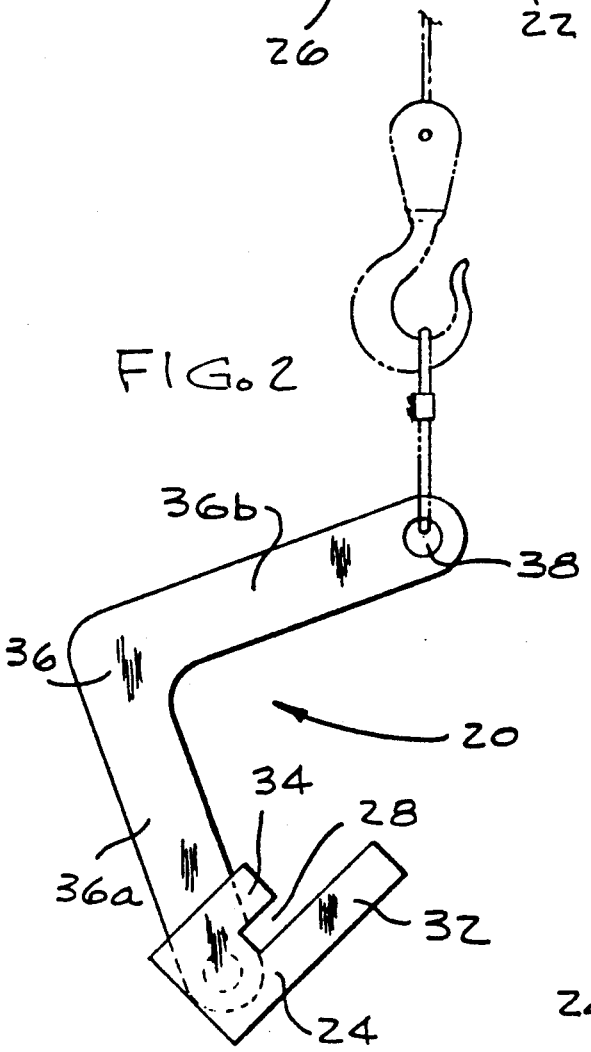
FIG. 2 is a side elevation view of the tool.
Figure 3:
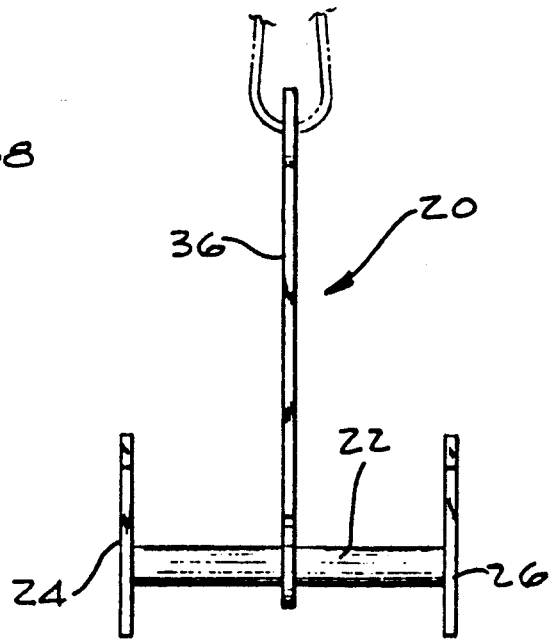
FIG. 3 is a front elevation view of the tool.

A tool constructed according to the principles of this invention for supporting a cutting blade in its correct angular orientation to facilitate its installation on a grader is indicated generally as 2" in the Figures. The tool 20 comprises an elongate bar 22, and first and second brackets 24 and 26 mounted on the bar at spaced locations. The bar 22 may be made of a 2" 0.D. steel pipe (or two sections of such pipe joined together). Each of the brackets 24 and 26 have a slot 28 therein for receiving and supporting a cutting blade 30. The slots 28 are generally parallel and co-planar. As best shown in FIG. 2, each of the brackets 24 and 26 comprises a first segment 32 for supporting the bottom of the blade, and a second segment 34, shorter that the first segment, and overlying a portion of the first segment to define the slot 28 between the first and second segments for receiving a portion of the blade. Thus, each of the brackets 24 and 26 has a generally J shape, and is attached to the bar 22 at the bottom of the "J", for example by welding. The brackets may be cut from ½" steel plate.

A generally L-shaped suspension member 36 is mounted on the bar 22, intermediate the brackets 24 and 26. The suspension member 36 comprises a first segment **36*a* extending from the bar 22, and a second segment 36*b* extending generally perpendicularly from the first segment. The suspension member may also be cut from ½" steel plate. The second segment 36*b* is preferably longer than the first segment 36*a*. The suspension member 36 is oriented with respect to the brackets 24 and 26 so that when the tool 20 is suspended by the suspension member 36, a blade 30 in the slots 28 in the brackets is supported at approximately the angle at which it is mounted on the grader. In this preferred embodiment, the angle between the plane of the slots 28 in the brackets and the first segment 36*a*** of the support arm is about 80°.

The free end of the second segment **36*b* has an opening 38 by which the tool can be suspended from the hook of, for example, an overhead crane, a hoist, or a cherry picker. The tool 20 is configured so that when a blade 30 is supported in t-he brackets, and the tool suspended from the opening 38 in the suspension member 36, the blade is supported in approximately the same angle that it is mounted on the grader. The tool can then be used to transport the blade 30 to the grader, and hold the blade 30** in place while the blade is being secured to the grader. The tool can also be used to support the blade as it is being removed from the grader.

OPERATION

In operation, the tool 20 is suspended from a hook on a crane or hoist. A blade 30 is inserted into the slots 28 in the brackets 24 and 26. The blade is generally centered with respect to the tool, with the suspension member 36 generally aligned with the center of the blade 30 so that the blade is balanced, and is supported in a generally horizontal, level orientation. Under the weight of the blade, the tool pivots slightly so that the blade is suspended at approximately the same angle at which it is mounted to the grader. The blade is transported to the grader in the tool, and held in place as the blade is secured to the grader. The tool 20 is simply pulled from the blade when the installation is complete.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tool for temporarily supporting a cutting blade in its correct angular orientation to facilitate its installation on a grader, the tool comprising:

an elongate bar;

first and second brackets mounted on the bar at spaced locations, the brackets including means for receiving and supporting the cutting blade;

a suspension member on the bar, intermediate the brackets, the suspension member being at such an angle with respect to the brackets that when the tool is suspended by the suspension member, a blade supported in the brackets slopes upwardly forward of the brackets at an acute angle with respect to a generally vertical line including the center of gravity of the tool so that the blade is at approximately the angular orientation at which it is mounted on the brader.

2. The tool according to claim 1 wherein the means for receiving and supporting the cutting blade comprises a slot in each brackets, the slots in the brackets being parallel to hold the cutting blade in a plane.

3. The tool according to claim 1 wherein the suspension member is generally L-shaped, comprising a first segment extending generally rearwardly from the bar, and a second segment extending generally perpendicularly from an upper end of the first segment and forwardly of the bar.

4. The tool according to claim 3 wherein the means for receiving and supporting the cutting blade comprises a slot in each bracket, the slots in the brackets being parallel and co-planar to hold the cutting blade in a plane.

5. The tool according to claim 4 wherein the angle between the plane of the slots in the brackets and the first segment of the suspension member is about 80°.

6. The tool according to claim 1 wherein each bracket is generally J shaped, and is attached to the bar at the bottom of the "J".

7. The tool according to claim 1 wherein each bracket is generally perpendicular to the axis of the bar.

8. The tool according to claim 7 wherein each bracket comprises a first segment for supporting the bottom of the blade, and a second segment, shorter than the first segment, and overlying a portion of the first segment to define a slot between the first and second segments for receiving a portion of the blade.

9. A tool for supporting a cutting blade in its correct angular orientation to facilitate its installation on a grader, the tool comprising:

an elongate bar;

first and second brackets mounted on the bar at spaced locations, each bracket having a slot for receiving and supporting the cutting blade, the slots being generally parallel and lying generally in a plane; a generally L-shaped suspension member on the bar, intermediate the brackets, the suspension member comprising a first segment extending generally rearwardly from the bar, and a second segment extending generally perpendicularly from an upper end of the first segment and forwardly of the bar, the plane including the slots sloping upwardly forward of the slots and intersecting a line coinciding with the longitudinal axis of the second segment so that when the tool is suspended by the suspension member, a blade in the slots in the brackets is supported at approximately the angle at which it is mounted on the grader.

10. The tool according to claim 9 wherein the angle between the plane of the slots in the brackets and the first segment of the suspension member is about 80°.

11. The tool according to claim 9 wherein the second segment of the suspension member is longer than the first segment of the suspension member.

12. The tool according to claim 9 wherein each brackets is generally J shaped, and is attached to the bar at the bottom of the "J".

13. The tool according to claim 9 wherein each bracket comprises a first segment for supporting the bottom of the blade, and a second segment, shorter that the first segment, and overlying a portion of the first segment to define a slot between the first and second segments for receiving a portion of the blade.

* * * * *

UNITED STATES PATENT AND TRADEMARK OFFICE

CERTIFICATE OF CORRECTION

PATENT NO. : 5,071,183

DATED : December 10, 1991

INVENTOR(S) : Jerry L. McDermott, et. al.

It is certified that error appears in the above-indentified patent and that said Letters Patent is hereby corrected as shown below:

Column 1, line 26, "one graders" should read --on graders--.

Column 2, line 18, "2'''' should read --20--.

Column 2, line 56, "t-he" should read --the--.

Column 3, claim 1, line 39, "brader" should read --grader--.

Column 3, claim 2, line 42, "brackets" should read --bracket--.

Signed and Sealed this

Sixth Day of July, 1993

*Attest:*

Michael K. Kirk

MICHAEL K. KIRK

*Attesting Officer*

*Acting Commissioner of Patents and Trademarks*